United States Patent [19]

Rhoda

[11] 4,358,352

[45] Nov. 9, 1982

[54] ELECTRODEPOSITION OF PLATINUM FROM A CIS-DIAMMINEDIHALOPLATINUM (II) ELECTROLYTE

[75] Inventor: Richard N. Rhoda, Suffern, N.Y.

[73] Assignee: MPD Technology Corporation, Wyckoff, N.Y.

[21] Appl. No.: 275,725

[22] Filed: Jun. 22, 1981

[51] Int. Cl.[3] ..... C25D 3/52

[52] U.S. Cl. ..... 204/47

[58] Field of Search ..... 204/47, 43 N, 109, 123

[56] References Cited

U.S. PATENT DOCUMENTS 1,981,715 11/1934 Atkinson ..... 204/47 X 2,452,308 10/1948 Lambros ..... 204/47

*Primary Examiner*—G. L. Kaplan

*Attorney, Agent, or Firm*—Ewan C. MacQueen; Raymond J. Kenny

[57] ABSTRACT

A platinum electroplating bath comprising cis diammine dichloroplatinum (II) or cis diammine diiodo platinum (II), sodium chloride or sodium iodide and a liquid phase comprising water and dimethylformamide in volume ratios of about 1:1 to about 1:2.

2 Claims, No Drawings

ELECTRODEPOSITION OF PLATINUM FROM A CIS-DIAMMINEDIHALOPLATINUM (II) ELECTROLYTE

The present invention is directed to a bath and process for the electrodeposition of platinum utilizing a complex platinum compound as the effective ingredient in the bath.

BACKGROUND OF THE INVENTION

As is known, electrodeposits of platinum have considerable utility in the industrial world. In particular, electrodeposited platinum is useful as an electrode material per se and especially when deposited on metals such as titanium and tantalum. In addition, platinum is known as an effective barrier in high temperature electronic applications. Plating baths based upon the water-soluble salt, platinum diammine dinitrite, have been used for approximately fifty years. The invention is directed to the provision of a new platinum electroplating bath and process for producing electrodeposits of platinum.

SUMMARY OF THE INVENTION

The invention is directed to aqueous plating baths containing as effective ingredients cis diammine dichloroplatinum (II) and dimethylformamide, and to the electrodeposition of platinum therefrom.

DETAILED DESCRIPTION OF THE INVENTION

In accordance with the invention an electroplating bath is provided containing about 8 grams to about 10 grams per liter of platinum added to the bath as a complex salt from the group consisting of cis diammine dichloroplatinum (II) and cis diammine diiodo platinum (II), a halide salt from the group consisting of sodium chloride and sodium iodide in the amount of about 15 to about 25 grams per liter and a liquid phase comprising water and dimethylformamide in volume ratios of about 1:1 to about 1:2. Preferably, sodium iodide is employed with the diido platinum salt, and sodium chloride is employed with the dichloro platinum salt.

The bath can be employed to produce sound adherent platinum electrodeposits at a cathode immersed therein employing a cathode current density of about 0.5 to about 2 amperes per square decimeter, a bath temperature in the range of about 45° C. to about 70° C., and a bath pH from about 6.0 to about 9.0. Cathode current efficiencies up to about 50% can be obtained.

Those skilled in the art will appreciate that the function of the dimethylformamide in the bath is to act as solvent for the water-insoluble platinum salt, while the halide salt contributes to conductivity of the bath.

There is no need for preplating the cathode to be immersed in the bath, since immersion coating of platinum on the cathode to be plated does not occur. As is known, the anode employed in the bath is insoluble and may comprise platinum, platinum-coated titanium and stainless steel. Deposits having a thickness up to about 30 microinches have been produced, which have good adhesion as determined by the scotch tape test.

Some examples will now be given.

A cell having a capacity of 500 milliliters and provided with an insoluble platinum anode and a copper cathode was prepared.

Three runs were made using an electrolyte based on cis diammino dichloroplatinum (II) and two runs were made using an electrolyte based on cis diammino diiodo platinum (II). The runs are identified respectively as runs 1–3 (chloride species) and runs 4–5 (iodo species) in the following table. In the table the concentration of platinum salt, dimethylformamide, water and conductive halide salt are given together with the current density, pH, temperature, cathode current efficiency and subjective the evaluation of the deposits produced. In each instance, mild agitation of the bath was employed.

The deposits were judged to be of sufficient quality so as to be useful in decorative applications.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

PLATINUM DEPOSITION FROM CIS-$Pt(NH_3)_2X_2$ ELECTROLYTES

| | Electrolyte | | | | BATH OPERATION | | | | | | |
|---|---|---|---|---|---|---|---|---|---|---|---|
| | Concentration gpl | | | | | | | | | | |
| Run | Salt | Pt | Liquid Phase mlDMF/ml$H_2O$ | Suppporting Salt/gpl | CD amp/dm$^2$ | pH | Temp °C. | Cathode Current Efficiency % | Deposit | Thick $\mu$ in | Adhesion (scotch tape test) |
| 1 | 15.4 | 10 | 500/500 | NaCl/20 | 1 | 8.8 | 60 | 15 | metallic & matte | 10 | good |
| 2 | 15.4 | 10 | 500/500 | NaCl/20 | 1 | 8.8 | 60 | 24 | metallic & matte | 30 | good |
| 3 | 15.4 | 10 | 500/500 | NaCl/20 | 1 | 6.1 | 60 | 10 | metallic & matte | 30 | good |
| 4 | 24.8 | 10 | 667/333 | NaI/20 | 1 | 8.1 | 60 | 51 | mostly metallic | 30 | good |
| 5 | 24.8 | 10 | 667/333 | NaI/20 | 1 | 6.0 | 60 | 36 | mostly metallic | 25 | good |

I claim:

1. A platinum electroplating bath containing about 8 grams to about 10 grams per liter of platinum added to the bath as a complex salt from the group consisting of cis diammine dichloroplatinum (II) and cis diammine diiodo platinum (II), a salt from the group consisting of sodium chloride and sodium iodide in the amount of about 15 to about 25 grams per liter and a liquid phase comprising water and dimethylformamide in volume ratios of about 1:1 to about 1:2.

2. The method for electrodepositing platinum which comprises cathodically depositing platinum from the bath of claim 1 while maintaining the bath temperature between about 45° C. and about 70° C., the bath pH from about 6.0 to about 9.0 and the cathode current density between about 0.5 and about 2 amperes per square decimeter.

* * * * *